US006699805B2

(12) United States Patent
Truesdale, III

(10) Patent No.: US 6,699,805 B2
(45) Date of Patent: Mar. 2, 2004

(54) DYED MELAMINE FABRICS AND METHODS FOR DYEING MELAMINE FABRICS

(75) Inventor: Rembert J. Truesdale, III, Thomaston, GA (US)

(73) Assignee: Southern Mills, Inc., Union City, GA (US)

( * ) Notice: Subject to any disclaimer, the term of this patent is extended or adjusted under 35 U.S.C. 154(b) by 76 days.

(21) Appl. No.: 09/918,934

(22) Filed: Jul. 31, 2001

(65) Prior Publication Data

US 2002/0034905 A1 Mar. 21, 2002

Related U.S. Application Data

(60) Provisional application No. 60/221,761, filed on Jul. 31, 2000.

(51) Int. Cl.[7] ..... D03D 15/00

(52) U.S. Cl. ..... 442/191; 442/301; 442/302; 428/364; 428/365; 428/370; 428/373; 428/374; 8/920; 8/924; 8/925; 8/934

(58) Field of Search ..... 442/181, 199, 442/301, 302; 428/364, 365, 370, 373, 374; 8/529, 531, 920, 924, 925, 934

(56) References Cited

U.S. PATENT DOCUMENTS

| | | | | | |
|---|---|---|---|---|---|
| 3,918,901 | A | | 11/1975 | Ida et al. | 8/172 |
| 4,452,607 | A | * | 6/1984 | Wessely | 8/497 |
| 4,668,234 | A | | 5/1987 | Vance et al. | 8/115.6 |
| 4,741,740 | A | | 5/1988 | Davis et al. | 8/490 |
| 4,752,300 | A | | 6/1988 | Johnson | 8/584 |
| 4,759,770 | A | | 7/1988 | Cates et al. | 8/490 |
| 4,803,256 | A | * | 2/1989 | Luckenbach | 525/420 |
| 4,814,222 | A | | 3/1989 | Davis et al. | 428/229 |
| 5,074,889 | A | | 12/1991 | Hodge et al. | 8/602 |
| 5,174,790 | A | | 12/1992 | Riggins et al. | 8/490 |
| 5,215,545 | A | | 6/1993 | Cates et al. | 8/490 |
| 5,306,312 | A | | 4/1994 | Riggins et al. | 8/586 |
| 5,447,540 | A | | 9/1995 | Kobayashi et al. | 8/654 |
| 5,578,368 | A | | 11/1996 | Forsten et al. | 428/229 |
| 6,200,355 | B1 | * | 3/2001 | Gadoury | 8/578 |

* cited by examiner

*Primary Examiner*—Ula C. Ruddock
(74) *Attorney, Agent, or Firm*—Thomas, Kayden, Horstemeyer & Risley, LLP

(57) ABSTRACT

The present disclosure generally relates to dyed melamine fabrics and methods for dyeing melamine fabrics. In one arrangement, the fabrics comprise a plurality of melamine fibers, wherein the flame resistant fabric has been dyed through a beam dyeing process in which the fabric has not been mechanically agitated. In one arrangement, the methods comprise the steps of wrapping melamine fabric around a perforated beam of a beam dyeing machine such that several layers of fabric surround the beam, injecting dyebath into the beam so that it penetrates the fabric layers, and circulating the dyebath through the fabric layers until the fabric is dyed to a desired shade.

69 Claims, No Drawings

DYED MELAMINE FABRICS AND METHODS FOR DYEING MELAMINE FABRICS

RELATED APPLICATION

The present application claims the benefit of the filing date of U.S. Provisional Application Ser. No. 60/221,761, filed Jul. 31, 2000.

FIELD OF THE INVENTION

The present invention generally relates to flame resistant fabrics. More particularly, the present invention relates to dyed fabrics containing melamine fibers, as well as processes used to dye melamine fabrics.

BACKGROUND OF THE INVENTION

Melamine is a material used in the manufacturing of inherently flame resistant fibers. Melamine fibers are highly resistant to heat decomposition and are therefore desirable in the manufacture of flame resistant garments intended for environments in which flames or extreme heat will be encountered. For example, melamine fibers are occasionally used in the construction of outer shells for firefighter turnout gear.

Although highly flame resistant, melamine fibers have relatively low abrasion resistance due to the low tenacity of the fibers. Because of this, melamine fibers are typically blended with other, higher tenacity, fibers when used in the construction of various garments. Such blending is typically necessary to satisfy various fabric standards, such as those specified by the National Fire Protection Association (NFPA), which establishes fabric guidelines for the firefighting industry. Normally, the fibers blended with the melamine fibers are similarly inherently flame resistant. By way of example, aramid fibers (e.g., para-aramid fibers) can be blended with the melamine fibers to achieve a commercially viable garment material.

After such fabric blends have been constructed, they are usually dyed a desired shade of color. Where the melamine blend includes an aramid, typically only the melamine component of the blend is dyed due to the adverse affects the acidic conditions generally considered necessary for dyeing or coloring aramid fibers have on the melamine fibers. Where dark shades are desired, the melamine fibers may be blended with producer-colored aramid fibers. As is known in the art, producer-coloring involves the addition of pigment to the fibers during the fiber spinning process.

Most often, melamine blends are dyed in a jet dyeing procedure. In this procedure, the ends of the fabric (in rope form) are joined so that the fabric forms a continuous loop of material within a jet dyeing machine. Once so disposed, the fabric, along with the dyebath, is circulated through a continuous path within the machine with the aid of a venturi jet that is powered by a pump.

Although providing for dyeing of the melamine fibers, use of jet dyeing machines can damage melamine fabrics due to the relatively low tenacity of the melamine fibers within the fabrics. In particular, the agitation the fabric experiences while being circulated within the jet dyeing machine can adversely affect the strength of the melamine fibers and, therefore, the melamine fabric as a whole. For example, jet dyeing can significantly reduce the trapezoidal tear strength of melamine fabrics to the point at which they may not satisfy NFPA requirements. Accordingly to NFPA 1971, 2000 edition, fabrics used to construct outer shells of firefighter turnout gear must exhibit a trapezoidal tear strength of at least 100 newtons (N) (22 pound-force (lbf.)) in the warp and filling directions both before and after five launderings conducted in accordance with NFPA 1971.

Testing was performed to determine the effect jet dyeing has on the strength of melamine fabrics. In this testing, a 60/40 blend of melamine and para-aramid fibers was dyed in a jet dyeing machine under normal dyeing conditions. Later, the blend was tested in accordance with NFPA 1971 and was found to have trapezoidal tear strengths of 32 lbf. in the warp direction and 25 lbf. in the filling direction before laundering, and 32 lbf. in the warp direction and 25 lbf. in the filling direction after five launderings. Although these values each were greater than the 22 lbf. required by NFPA 1971, the filling direction strength values are only marginally acceptable. As noted above, further strength loss can be observed when the blends are dyed in acidic conditions in an attempt to dye or color the non-melamine component(s) of the blend. Although such acidic dyeing is not necessary when producer-colored fibers are used, producer-colored fibers are relatively expensive and are therefore economically undesirable.

In addition to strength problems, other difficulties can arise when jet dyeing melamine fabrics. Specifically, it can be difficult to attain high shade consistency when jet dyeing machines are used. Such problems may again be due to the relatively low tenacity of melamine fibers. In particular, the melamine fibers may cause excessive creasing of the fabric within the jet dyeing machine which can result in the formation of "crack" marks, i.e. relatively dark lines that form along fabric creases during the dyeing process.

In view of the above, it can be appreciated that it would be desirable to have dyed melamine fabrics that do not suffer from the aforementioned drawbacks as well as methods for dyeing the fabrics so as to avoid those drawbacks.

SUMMARY OF THE INVENTION

The present disclosure generally relates to dyed melamine fabrics and methods for dyeing melamine fabrics.

In one arrangement, the fabrics comprise a plurality of melamine fibers, wherein the flame resistant fabric has been dyed through a beam dyeing process in which the fabric has not been mechanically agitated.

In one arrangement, the methods comprise the steps of wrapping melamine fabric around a perforated beam of a beam dyeing machine such that several layers of fabric surround the beam, injecting dyebath into the beam so that it penetrates the fabric layers, and circulating the dyebath through the fabric layers until the fabric is dyed to a desired shade.

The features and advantages of the invention will become apparent upon reading the following specification.

DETAILED DESCRIPTION OF THE INVENTION

Introduction

As summarized above, various problems exist in the production of melamine fabrics. Specifically, it can be difficult to produce dyed melamine fabrics that possess good strength and shade consistency. Accordingly, this disclosure is directed to dyed melamine fabrics that are strong and/or that have good shade consistency. As used herein, the term "melamine fabric" designates any fabric that contains melamine fibers. Furthermore, it is to be noted that, when a material name is followed by the term "fiber," the fiber described is not limited to fibers composed exclusively of the named material. Therefore, the term "melamine fiber" includes any fiber that contains melamine.

This disclosure is also directed to methods for dyeing melamine fabrics in a manner in which high strength is maintained and/or good shade consistency is achieved. The discussion that follows begins with an identification of example fabric constructions. Next, the discussion describes dyeing methods used to dye these fabrics. Finally, the discussion provides various examples of dyeing procedures and coloration results.

Fabric Construction

As noted above, the fabrics described herein comprise melamine fibers. Melamine is a material that can be used as a building block for condensation synthesis with formaldehyde to facilitate the formation of three-dimensional polymeric lattices. In the condensation reaction, methylol compounds are initially formed that react with each other to form a three-dimensional structure of methylene ether and methylene bridges. Fibers can then be formed of a condensation polymer by reacting a mixture comprising 30% to 99% molar melamine, 1% to 70% molar substituted melamine, and 0.1% to 10% molar phenols or substituted phenols, with formaldehyde or formaldehyde-liberating compounds, the molar ratio of melamine to formaldehyde ranging from 1:1.5 to 1:4.5. Suitable melamine fibers are currently available from BASF under the tradename Basofil™ and can be formed as described in U.S. Pat. No. 5,560,990, which is hereby incorporated by reference into this disclosure Typically, the melamine fibers are blended with at least one other type of fiber (i.e., blending fibers) to form a fabric blend. To attain a highly flame resistant end fabric, the blending fibers normally comprise other inherently flame resistant fibers. Example blending fibers include aromatic polyamide (i.e., aramid) fibers and polybenzimidazole (PBI) fibers. In a preferred arrangement, the fibers comprise an aramid such as para-aramid. Para-aramid fibers are particularly desirable for blending with the melamine fibers in that para-aramid fibers are very strong, typically having tenacity values between approximately 21–28 grams per denier (g/d) and tensile strengths of about 400 pounds per square inch (psi). Para-aramid fibers are currently available under the trademarks Kevlar™ from DuPont and Technora™ and Twaron™ from Teijin.

Once the blending fibers have been selected, the melamine fibers and the blending fibers are spun together, normally in staple form, to form yam. Of the many blends conceivable with the above-noted blending fibers, preferred is a blend of melamine fibers and para-aramid fibers. Generally speaking, the fabric comprises approximately 20% to 75% melamine fibers by composition with the blending fibers making up the balance. Preferably, however, the composition of the fabric is approximately 30% to 50% melamine fibers and approximately 70% of 50% blending fibers (including para-aramid fibers) to obtain the desired fabric flame resistance and strength. By way of example, the fabric blends can comprise 40% melamine fibers and 60% para-aramid fibers.

The selected fibers can be, for instance, ring spun into yarns of an appropriate weight. By way of example, each yarn can be spun to have a yarn count (traditionally known as "cotton" count) of approximately 20/2. The yarn can then be used to form the fabric blend. Normally, the yarns are woven together to form a plain, rip stop, or twill weave. Alternatively, the yarns can be combined in other manners. For instance, if desired, the yarns can be knitted together to form the melamine fabric.

The fabric can be constructed such that is has a weight of approximately 5 to 9 ounces per square yard (oz/yd$^2$) with approximately 7.5 oz/yd$^2$ being preferable for turnout gear construction. To achieve such a fabric weight with the yarns described above, the fabric can be formed so as to have approximately 57 ends per inch and approximately 49 picks per inch.

Fabric Dyeing

Once the fabric is made, it can be dyed to give it the desired color. Due to the disadvantages noted above, the blended fabric preferably is not dyed in a jet dyeing machine. Instead, the fabric is dyed in a beam dyeing process. In such a process, the fabric is wound around a perforated beam of a beam dyeing machine. Once the fabric is wound about the beam, dyebath is injected (typically pumped) into the interior of the beam and therefore forced outwardly through the perforations of the beam and into the fabric such that it circulates through the fabric. Although beam dyeing is a known method for dyeing other materials, manufacturers and fabric suppliers recommend against beam dyeing melamine fabrics due to the nature of the melamine fibers. Specifically, it is believed that the melamine fibers decrease the permeability of the fabric to the extent that the dyebath cannot effectively circulate through the fabric, thereby preventing commercially acceptable dyeing.

Contrary to these beliefs, applicants have determined that melamine fabric can be beam dyed with good results in accordance with the methods disclosed herein. Moreover, the blending fiber component (e.g., aramid component) can be simultaneously dyed and/or colored through these methods without exposing the melamine to unduly acidic conditions. Generally speaking, the dyeing is conducted by injecting a neutral, aqueous dyeing solution of disperse (nonionic) dyes for light to medium shades, or a lightly acidic (pH approximately 5–6) combination of disperse and acid (anionic) dyes for dark shades, through the perforated beam. By way of example, the fabric can be wound around the beam to a thickness of approximately 6 inches (in.) to 25 in., which translate to roughly 100 yards to 1250 yards of fabric with the fabric weight ranges noted above.

The fabric is typically first pre-scoured with an alkaline media (pH approximately 8–10.9) and a surfactant, then rinsed. Dyeing is then conducted at temperatures of approximately 250° F. for light to medium shades and approximately 270° F. for dark shades. To aid in the dyeing and/or coloring of the blending fibers (e.g., para-aramid fibers), dye assistants can be used in the dyebath. When used, the dye assistants can be used in a concentration of approximately 30 to 100 grams per liter (g/l). Example dye assistants for this purpose include benzyl alcohol, aryl ether, N-cyclohexylpyrrolidone (CHP), Cindye NPC™ (from Stockhausen, Inc., Greensboro, N.C.), dibutyl-formamide, N,N-diethyl-m-toluamide, dibutylacetamide, Burcocarrier CAT™ (from Burlington Chemical Co., Burlington, N.C.), 1-octyl-2-pyrolidinone, and mixtures thereof. Of these, particularly advantageous results have been observed with benzyl alcohol and aryl ether. In most situations, the fabric is held at the dyeing temperature for approximately 30 to 90 minutes. After dyeing is completed, the fabric is subjected to a number of rinses with a surfactant/dye dispersant mixture to remove loose dyestuff. For fabrics dyed with the aid of a dye assistant, these fabrics can also be rinsed with a reductive clear.

According to this method, the fabric remains still during the dyeing process and therefore is not agitated as when jet dyeing machines are used. Therefore, the mechanical characteristics, such as trapezoidal tear strength, are not adversely affected. Example trapezoidal tear strengths are provided in Table I for a 200 yard sample of a 40/60 melamine/para-aramid blend that was dyed a gold/yellow shade in accordance with the above-described procedures.

TABLE I

| TRAPEZOIDAL TEAR STRENGTH | | |
|---|---|---|
| | Warp direction (lbf.) | Filling direction (lbf.) |
| Unlaundered | 45 | 44 |
| After 5 launderings | 39 | 36 |

When compared to the values noted above associated with jet dyed melamine fabric, it can be appreciated that substantially improved strength can be achieved when melamine fabrics are dyed in accordance with this disclosure as opposed to being jet dyed. In addition to maintaining the strength of the fabric, excellent dyeing consistency can be achieved. Specifically, in that the fabric remains flat during the dyeing process, cracking that can occur due to the formation of creases during jet dyeing is avoided. Hence, through the present method, relatively strong, consistently dyed melamine fabrics can be obtained.

EXAMPLES

General guidelines for fabric constructions and dyeing methods having been described above, various specific examples will now be provided that identify particular fabrics that can be produced and dyeing methods that can be used according to this disclosure. In addition, shade depth information is provided to indicate the level of dyeing that can be achieved.

Example 1

Various samples of a 40/60 blend of melamine/para-aramid fabric were dyed a gold color. The fabric comprised 7.4–8.2 oz/yd$^2$, 3×3 ripstop weaves of ringspun 20/2 40/60 melamine/para-aramid yarns having 57 +/−2 ends×49 +/−2 picks. Samples ranging from approximately 250 to 1200 yards in length were wrapped about a perforated 58 in. OD Gaston County beam of a beam dyeing machine in each trial. Once loaded in the machine, a prescour solution of approximately 0.5 g/l sodium carbonate, 0.5 g/l wetting agent, and 0.5% on weight of fabric (owf) defoamer was injected into the beam and circulated through the fabric at approximately 185° F. for approximately fifteen minutes. Next water was injected at approximately 160° F. for approximately ten minutes and then at approximately 130° F. for approximately ten minutes.

Next, an aqueous dye solution containing approximately 0.53% owf disperse Yellow 64, 0.12% owf disperse Red 91, 0.08% owf disperse Red 60, 0.10% owf disperse Blue 56, 0.25 g/l disperse dye dispersant, 1.0 g/l leveling agent, and 0.5% owf defoamer was injected into the beam and circulated through the fabric for approximately 45 minutes at approximately 250° F. After the expiration of that time period, an aqueous solution containing approximately 2.0 g/l surfactant/dye dispersant was injected into the beam for approximately ten minutes at approximately 160° F. Next, water was injected into the beam for approximately ten minutes at approximately 160° F. and approximately ten minutes at approximately 130° F.

At this point, the unfinished fabric was removed and tested to determine shade depth. Through testing using a Hunterlab Ultrascan XE™ spectrophotomer, L* values ranging from approximately 57–60 were observed. Next, the fabric was finished through a pad application of durable water repellent finish and cured in a tenter oven for approximately two minutes to a fabric temperature in excess of approximately 350° F. The shade depth of the fabric was again determined, and L* values ranging from approximately 53–57 were observed.

Example 2

In the second example, various samples of the melamine/para-aramid fabric described above in Example 1 were dyed a khaki/light brown color. In these dyeing trials, approximately 250 yard samples of the fabric were wrapped about the perforated beam of the beam dyeing machine. Again, once loaded in the machine, a prescour solution of approximately 0.5 g/l sodium carbonate, 0.5 g/l wetting agent, and 0.5% owf defoamer was injected into the beam at approximately 185° F. for approximately fifteen minutes. Next, water was injected at approximately 160° F. for approximately ten minutes and then at approximately 130° F. for approximately ten minutes.

An aqueous dye solution containing approximately 0.43%–0.86% owf disperse Yellow 64, 0.14% owf disperse Red 91, 0.09% owf disperse Red 60, 0.09%–0.15% owf disperse Blue 56, 0.25 g/l disperse dye dispersant, 1.0 g/l leveling agent, 0.5% owf defoamer, and 20–60 g/l of aryl ether dye assistant was then injected into the beam and circulated through the fabric for approximately forty-five minutes at approximately 250° F. After dyeing, an aqueous solution containing approximately 2.0 g/l surfactant/dye dispersant was injected into the beam for approximately ten minutes at approximately 160° F. Next, water was injected into the beam for approximately ten minutes at approximately 160° F. and approximately ten minutes at approximately 130° F.

The unfinished fabric was observed to have L* values ranging from approximately 52–60 and the finished fabric exhibited L* values ranging from approximately 49–58.

Example 3

In the third example, various samples of the melamine/para-aramid fabric described above in Examples 1 and 2 were dyed a black color. In these dyeing trials, approximately 400 to 600 yard samples of the fabric were wrapped about the perforated beam of the beam dyeing machine. Again, a prescour solution of approximately 0.5 g/l sodium carbonate, 0.5 g/l wetting agent, and 0.5% owf defoamer was injected into the beam, and therefore into the fabric, at approximately 185° F. for approximately fifteen minutes. Next, water was injected at approximately 160° F. for approximately ten minutes and then at approximately 130° F. for approximately ten minutes.

An aqueous dye solution containing approximately 0.65%–1.04% owf disperse Yellow 64, 1.29%–2.06% owf disperse Red 91, 0.60%–0.98% owf disperse Red 60, 3.52%–5.63% owf disperse Blue 56, 0.25 g/l disperse dye dispersant, 1.0 g/l leveling agent, 0.5% owf defoamer, 60 g/l of benzyl alcohol dye assistant, and 20 g/l nitrate salt was then injected into the beam and circulated through the fabric for approximately sixty to ninety minutes at approximately 270° F. After dyeing, an aqueous solution containing approximately 0.25% wetting agent, 3.0% soda ash, and 0.5% of a thiourea dioxide reducing agent was injected into the beam for approximately ten minutes at approximately 160° F. Finally, water was injected into the beam for approximately ten minutes at approximately 160° F. and approximately ten minutes at approximately 130° F.

The unfinished fabric was observed to have L* values ranging from approximately 28–35 and the finished fabric exhibited L* values ranging from approximately 26–34.

Example 4

In the fourth example, various samples of the melamine/para-aramid fabric described above in Examples 1–3 were dyed a black color. In these dyeing trials, approximately 400 to 600 yard samples of the fabric were wrapped about the perforated beam of the beam dyeing machine. A prescour solution of approximately 0.5 g/l sodium carbonate, 0.5 g/l wetting agent, and 0.5% owf defoamer was injected into the beam, and therefore into the fabric, at approximately 185° F. for approximately fifteen minutes. Next, water was injected at approximately 160° F. for approximately ten minutes and then at approximately 130° F. for approximately ten minutes.

Next, an aqueous dye solution containing approximately 0.65%–1.04% owf disperse Yellow 64, 1.29%–2.06% owf disperse Red 91, 0.60%–0.98% owf disperse Red 60, 3.52%–5.63% owf disperse Blue 56, 1.0% acid Black 194, 5.45 g/l acid donor, 0.25 g/l disperse dye dispersant, 1.0 g/l disperse dye leveling agent, 2.0 g/l acid dye leveling agent, 0.5% owf defoamer, 60 g/l of benzyl alcohol dye assistant, and 20 g/l nitrate salt was injected into the beam and circulated through the fabric for approximately sixty minutes at approximately 270° F. After dyeing, an aqueous solution containing approximately 0.25% wetting agent, 3.0% soda ash, and 0.5% of a thiourea dioxide reducing agent was injected into the beam for approximately ten minutes at approximately 160° F. Finally, water was injected into the beam for approximately ten minutes at approximately 160° F. and approximately ten minutes at approximately 130° F.

The unfinished fabric was observed to have L* values ranging from approximately 22–23 and the finished fabric exhibited L* values ranging from approximately 19–22.

While various embodiments of the invention have been disclosed herein for purposes of example, it will be understood by those having ordinary skill in the art that variations and modifications thereof can be made without departing from the scope of the invention as set forth in the following claims.

I claim:

1. A dyed flame resistant fabric, comprising:

a plurality of melamine fibers;

wherein the flame resistant fabric has been dyed through a beam dyeing process in which the fabric has not been mechanically agitated.

2. The fabric of claim 1, further comprising a plurality of non-melamine, inherently flame resistant fibers.

3. The fabric of claim 2, wherein the non-melamine, inherently flame resistant fibers include aramid fibers.

4. The fabric of claim 2, wherein the non-melamine, inherently flame resistant fibers are para-aramid fibers.

5. The fabric of claim 2, wherein the non-melamine, inherently flame resistant fibers have been dyed through the beam dyeing process.

6. The fabric of claim 2, wherein the fabric is approximately 20% to 75% melamine fibers by composition.

7. The fabric of claim 2, wherein the fabric is approximately 30% to 50% melamine fibers by composition.

8. The fabric of claim 2, wherein the fabric is approximately 40% melamine fibers by composition.

9. The fabric of claim 1, wherein the fabric is a woven fabric.

10. The fabric of claim 1, wherein the fabric has a weight of approximately 5 oz/yd$^2$ to 9 oz/yd$^2$.

11. The fabric of claim 1, wherein the fabric has a weight of approximately 7.5 oz/yd$^2$.

12. The fabric of claim 1, wherein the fabric has a trapezoidal tear strength of at least approximately 30 lbf. in the warp direction and at least approximately 25 lbf. in the filling direction.

13. The fabric of claim 1, wherein the fabric has shade depth L* value no greater than approximately 60.

14. The fabric of claim 1, wherein the fabric has shade depth L* value no greater than approximately 35.

15. The fabric of claim 1, wherein the fabric has shade depth L* value no greater than approximately 25.

16. A dyed flame resistant fabric, comprising:

a plurality of dyed melamine fibers; and a plurality of aramid fibers;

wherein the flame resistant fabric has been dyed through a beam dyeing process in which the fabric has not been mechanically agitated.

17. The fabric of claim 16, wherein the aramid fibers comprise para-aramid fibers.

18. The fabric of claim 16, wherein the aramid fibers have been dyed through the beam dyeing process.

19. The fabric of claim 16, wherein the fabric is approximately 20% to 75% melamine fibers by composition.

20. The fabric of claim 16, wherein the fabric is approximately 30% to 50% melamine fibers by composition.

21. The fabric of claim 16, wherein the fabric is approximately 40% melamine fibers by composition.

22. The fabric of claim 16, wherein the fabric has a composition of approximately 40% melamine fibers and approximately 60% para-aramid fibers.

23. The fabric of claim 16, wherein the fabric is a woven fabric.

24. The fabric of claim 16, wherein the fabric has a weight of approximately 5 oz/yd$^2$ to 9 oz/yd$^2$.

25. The fabric of claim 16, wherein the fabric has a weight of approximately 7.5 oz/yd$^2$.

26. The fabric of claim 16, wherein the fabric has a trapezoidal tear strength of at least approximately 30 lbf. in the warp direction and at least approximately 25 lbf. in the filling direction.

27. The fabric of claim 16, wherein the fabric has shade depth L* value no greater than approximately 60.

28. The fabric of claim 16, wherein the fabric has shade depth L* value no greater than approximately 35.

29. The fabric of claim 16, wherein the fabric has shade depth L* value no greater than approximately 25.

30. A dyed, woven flame resistant fabric suitable for use in the construction of firefighter turnout gear, comprising:

a plurality of dyed melamine fibers; and a plurality of dyed para-aramid fibers;

wherein the flame resistant fabric has a composition that comprises approximately 30% to 50% melamine fibers and approximately 70% to 50% para-aramid fibers;

wherein the melamine fibers and the para-aramid fibers have been dyed through a beam dyeing process in which the fabric has not been mechanically agitated.

31. The fabric of claim 30, wherein the fabric has a composition of approximately 40% melamine fibers and approximately 60% para-aramid fibers.

32. The fabric of claim 30, wherein the fabric has a weight of approximately 5 oz/yd$^2$ to 9 oz/yd$^2$.

33. The fabric of claim 30, wherein the fabric has a weight of approximately 7.5 oz/yd$^2$.

34. The fabric of claim 30, wherein the fabric has a trapezoidal tear strength of at least approximately 30 lbf. in the warp direction and at least approximately 25 lbf. in the filling direction.

35. The fabric of claim 30, wherein the fabric has shade depth L* value no greater than approximately 60.

36. The fabric of claim 30, wherein the fabric has shade depth L* value no greater than approximately 35.

37. The fabric of claim 30, wherein the fabric has shade depth L* value no greater than approximately 25.

38. A method for dyeing a melamine fabric, comprising the steps of:

wrapping the melamine fabric around a perforated beam of a beam dyeing machine such that several layers of fabric surround the beam;

injecting dyebath into the beam so that the dyebath penetrates the fabric layers; and circulating the dyebath through the fabric layers until the fabric is dyed to a desired shade.

39. The method of claim 38, wherein the melamine fabric comprises a plurality of melamine fibers and non-melamine, inherently flame resistant fibers.

40. The method of claim 39, wherein the fabric is approximately 20% to 75% melamine fibers by composition.

41. The method of claim 39, wherein the fabric is approximately 30% to 50% melamine fibers by composition.

42. The method of claim 39, wherein the fabric is approximately 40% melamine fibers by composition.

43. The method of claim 38, wherein the step of wrapping the melamine fabric around the perforated beam comprises wrapping approximately 100 to 1250 yards of fabric around the beam.

44. The method of claim 38, wherein the step of wrapping the melamine fabric around the perforated beam comprises wrapping the melamine fabric such that the fabric layers around the beam have a combined thickness of approximately 6 to 25 inches.

45. The method of claim 38, wherein the step of injecting dyebath into the beam comprises injecting a neutral aqueous solution into the beam.

46. The method of claim 45, wherein the dyebath comprises a disperse dye.

47. The method of claim 38, wherein the step of injecting dyebath into the beam comprises injecting a lightly acidic solution into the beam.

48. The method of claim 47, wherein the dyebath comprises a combination of disperse and acid dye.

49. The method of claim 38, wherein the dyebath includes a dye assistant.

50. The method of claim 49, wherein the dye assistant comprises one of aryl ether and benzyl alcohol.

51. The method of claim 38, wherein the fabric has a weight of approximately 5 oz/yd$^2$ to 9 oz/yd$^2$.

52. The method of claim 38, wherein, through the dyeing process, the fabric attains an L* value no greater than approximately 60.

53. The method of claim 38, wherein, through the dyeing process, the fabric attains an L* value no greater than approximately 35.

54. The method of claim 38, wherein, through the dyeing process, the fabric attains an L* value no greater than approximately 25.

55. A melamine fabric dyed in accordance with the method of claim 38.

56. A method for dyeing flame resistant fabric, comprising the steps of:

wrapping a flame resistant fabric comprising a plurality of melamine fibers and a plurality of aramid fibers around a perforated beam of a beam dyeing machine such that several layers of fabric surround the beam;

injecting dyebath into the beam so that the dyebath penetrates the fabric layers, the dyebath comprising an aqueous solution containing a disperse dye; and circulating the dyebath through the fabric layers until the fabric is dyed to a desired shade.

57. The method of claim 56, wherein the fabric is approximately 20% to 75% melamine fibers by composition.

58. The method of claim 56, wherein the fabric is approximately 30% to 50% melamine fibers by composition.

59. The method of claim 56, wherein the fabric is approximately 40% melamine fibers by composition.

60. The method of claim 56, wherein the step of wrapping the fabric around the perforated beam comprises wrapping approximately 100 to 1250 yards of fabric around the beam.

61. The method of claim 56, wherein the step of wrapping the fabric around the perforated beam comprises wrapping the melamine fabric such that the fabric layers around the beam have a combined thickness of approximately 6 to 25 inches.

62. The method of claim 56, wherein the dyebath comprises a combination of disperse and acid dye.

63. The method of claim 56, wherein the dyebath includes a dye assistant.

64. The method of claim 63, wherein the dye assistant comprises one of aryl ether and benzyl alcohol.

65. The method of claim 56, wherein the fabric has a weight of approximately 5 oz/yd$^2$ to 9 oz/yd$^2$.

66. The method of claim 56, wherein, through the dyeing process, the fabric attains an L* value no greater than approximately 60.

67. The method of claim 56, wherein, through the dyeing process, the fabric attains an L* value no greater than approximately 35.

68. The method of claim 56, wherein, through the dyeing process, the fabric attains an L* value no greater than approximately 25.

69. A melamine fabric dyed in accordance with the method of claim 56.

* * * * *